United States Patent [19]

Baran, Jr.

[11] Patent Number: 4,730,978

[45] Date of Patent: Mar. 15, 1988

[54] COOLING AIR MANIFOLD FOR A GAS TURBINE ENGINE

[75] Inventor: Walter J. Baran, Jr., South Glastonbury, Conn.

[73] Assignee: United Technologies Corporation, Hartford, Conn.

[21] Appl. No.: 924,008

[22] Filed: Oct. 28, 1986

[51] Int. Cl.[4] ..... F01D 5/14

[52] U.S. Cl. ..... 415/115; 415/175; 415/206

[58] Field of Search ..... 415/115, 175, 206; 416/95; 60/39.75

[56] References Cited

U.S. PATENT DOCUMENTS

| | | | |
|---|---|---|---|
| 4,236,869 | 12/1980 | Laurello | 415/115 |
| 4,435,123 | 3/1984 | Levine | 416/95 |
| 4,487,016 | 12/1984 | Schwarz et al. | 60/39.75 |

*Primary Examiner*—Robert E. Garrett
*Assistant Examiner*—Therese Newholm
*Attorney, Agent, or Firm*—Troxell K. Snyder

[57] ABSTRACT

A manifold (20) includes a plurality of separate, identical flow channels (28) separated by flow dividers (46). The flow dividers (46) include a thickened boss section (54) for receiving a mounting bolt (50), and are skewed adjacent the manifold outlet for forming a plurality of tangentially directed nozzles (18).

3 Claims, 8 Drawing Figures

COOLING AIR MANIFOLD FOR A GAS TURBINE ENGINE

FIELD OF THE INVENTION

The present invention relates to a structure for supplying cooling air to a turbine rotor of a gas turbine engine.

BACKGROUND

Gas turbine engine rotors are frequently cooled by a flow of air supplied to the radially inner portion of the rotor by a manifold structure which discharges the cooling air with a tangential velocity component selected to match the rotor angular velocity. Such structures, shown for example in U.S. Pat. No. 4,435,123 issued Mar. 6, 1984 to Levine, are mounted within the gas turbine engine and frequently support annular sealing surfaces or the like for establishing sealing between the various portions of the engine. The manifold structures receive cooling air from a pressurized annulus supplied by the upstream compressor section.

As will be appreciated by those skilled in the art, the uniformity of the discharged cooling air is a major factor in achieving the desired cooling effect on the outer turbine rotor structure and blades disposed in the heated combustion products. In addition to uniformity of flow, it may be necessary to monitor the pressure in the cooling flow volume adjacent the turbine rotor in order to verify the operation of the cooling system and to detect plugging or other flow abnormalities.

It will also be appreciated by those familiar with gas turbine engine development that the cooling requirements of the turbine first stage frequently change during the life of a particular engine design as the design is upgraded to provide increased or decreased power output. Cooling manifold designs of the prior art require resizing of the air flow passages and openings therewithin to accommodate the altered turbine rotor cooling demands, resulting in a plurality of similar but noninterchangeable parts for each family of related engine designs. Likewise, a change in rotor cooling demand for a particular engine in the field, such as might result from a change of engine materials, increased service life, etc., would require removal of the manifold presently in the engine and replacement with another specifically manufactured to deliver the desired cooling flow.

What is needed is a manifold able to deliver uniform flow to the turbine rotor and which may also be easily adapted to deliver different cooling air flows without being replaced.

SUMMARY OF THE INVENTION

It is therefore an object of the present invention to provide a flow directing manifold for delivering a rotating, annular flow of cooling air adjacent the radially inner face of a rotating turbine blade disk in a gas turbine engine or the like.

It is further an object of the present invention to provide a flow manifold configured to achieve a uniform distribution of cooling air adjacent the face of the turbine disk.

It is further an object of the present invention to provide a means for mounting the manifold within the gas turbine engine which does not disrupt the flow of air through the manifold.

It is further an object of the present invention to provide a means for adjusting the flow of air through the manifold in response to the cooling requirements of the turbine blade disk.

It is still further an object of the present invention to provide an integral pressure tap for monitoring manifold outlet pressure and cooling air flow.

According to the present invention, a cooling air manifold for injecting a swirling flow of cooling air tangentially against a radially inner portion of a rotating turbine disk is constructed of a plurality of adjacent, identical flow channels for receiving cooling air from an annular, substantially axially flowing pressurized air stream and conducting it radially inward to the manifold nozzles whence it is discharged tangentially against the rotating disk. The manifold according to the present invention is substantially symmetrical about the rotor axis of rotation, with the flow channels being defined by two generally frusto-conical walls having a plurality of flow dividers extending therebetween. Mounting for the manifold is provided by thickening the flow dividers for receiving a mounting bolt therewithin, thus allowing the manifold to be secured to the engine case or frame without disrupting the internal flow of air.

The flow dividers are curved adjacent the outlet of the manifold for forming the manifold exhaust nozzles which both accelerate and impart the tangential velocity component to the discharged cooling air. The individual flow channels avoid the shared air inlet and plenum arrangement of the prior art which can cause internal fluid pressure losses and imbalanced air flow.

Another feature of the manifold according to the present invention is the adjustment of the rate of air flowing therethrough without reconfiguring the entire manifold. This adjustment, or trim, is accomplished in the present invention by providing a flattened surface adjacent the inlet opening of each flow channel for receiving a corresponding flow blocking plate. The blocking plate cuts down the flow of air into the manifold thus providing an easy means for modifying the cooling performance of the air stream. Should additional air flow be required, a thickened region in the frusto-conical wall proximate the turbine rotor is provided through which a flow trim hole is bored, thereby allowing a portion of the cooling air to be discharged from the manifold, bypassing the discharge nozzles.

The manifold also provides a secondary flow of cooling air between the axially flowing pressurized air stream and the radially inward portion of the turbine blades attached to the rotor disk. A plurality of skewed holes are disposed in an outer peripheral flange formed in a third frusto-conical wall adjacent the turbine inlet. The skewed holes discharge the secondary air tangentially against the attached disk and blades for preventing hot combustion gases from flowing radially inward over the disk face.

It is still further a feature of the manifold according to the present invention to provide a pressure tap passage extending between the engine volume receiving the air discharged from the manifold nozzles to an upstream pressure port for connection to a pressure monitor. Discharge pressure is thus monitored adjacent the rotating disk without disrupting the manifold internal cooling air flow.

Both these and other features and advantages of the manifold according to the present invention will become apparent to those skilled in the art upon inspection of the following specification and the appended claims and drawing figures.

DETAILED DESCRIPTION OF THE PREFERRED EMBODIMENT

Figure 1:
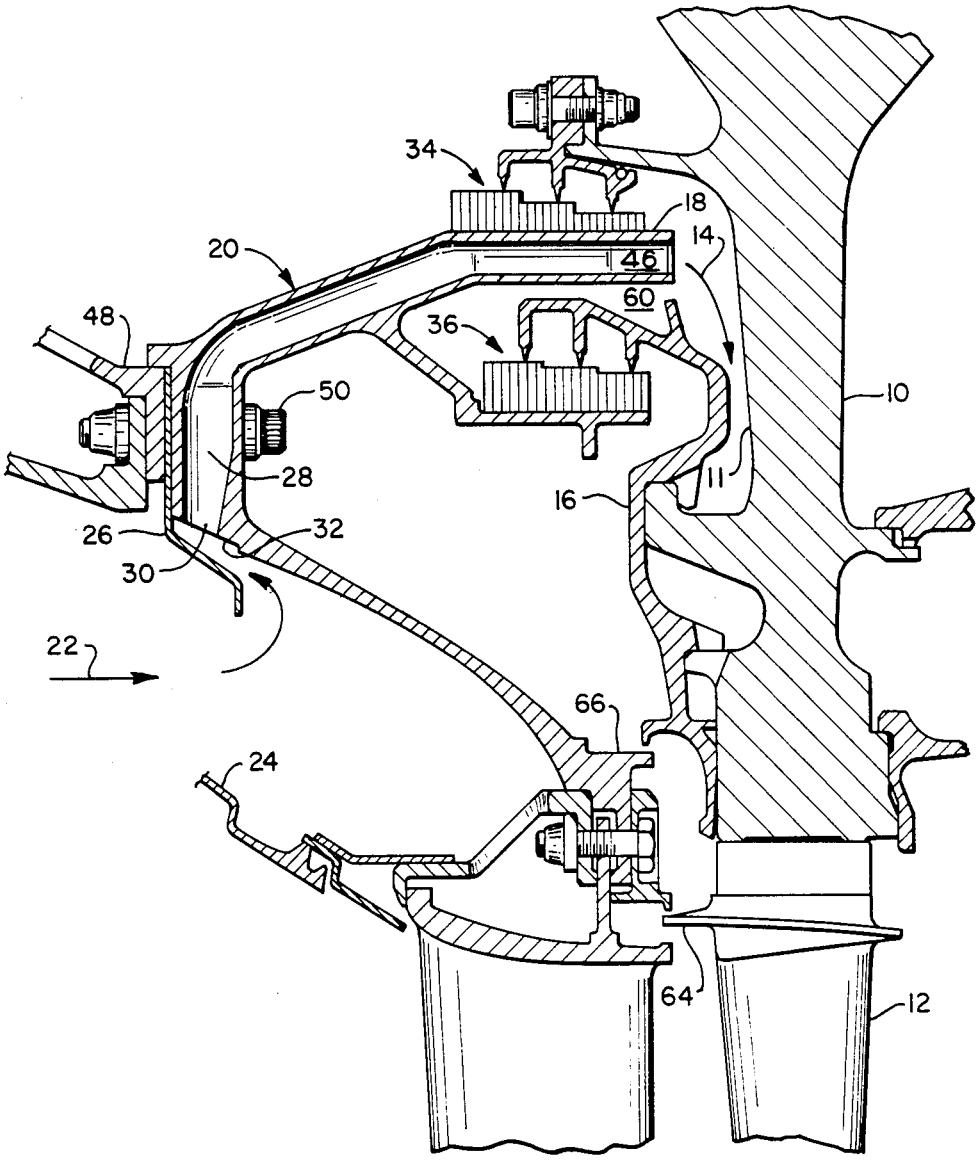
FIG. 1 shows an axial cross section of a turbine disk, combustor discharge, and manifold according to the present invention.

FIG. 1 shows a cross sectional view of a portion of a gas turbine engine in the vicinity of the first turbine rotor stage. The turbine rotor disk 10 and blades 12 are cooled by a stream of air 14 flowing radially outward between an annular side plate 16 and the turbine rotor 10. The stream of air 14 is discharged from the nozzles 18 of an annular cooling air manifold 20 according to the present invention. The cooling air manifold 20 receives the cooling air from an annular, generally axially flowing stream of pressurized cooling air 22 flowing radially inward of an inner burner liner 24.

The cooling air 22 flows around a radially extending dirt deflector 26, entering a plurality of flow channels 28 formed within the manifold 20. The channel inlet openings 30 are each surrounded by a flattened surface 32 for receiving a flow blocking plate as discussed hereinbelow. Rotating seals 34, 36 disposed between the manifold and the rotor disk and side plate, respectively, prevent leakage of the discharged cooling air 14 from the volume 60 adjacent the face 11 of the turbine disk 10 into lower pressure regions of the engine.

Figure 2:
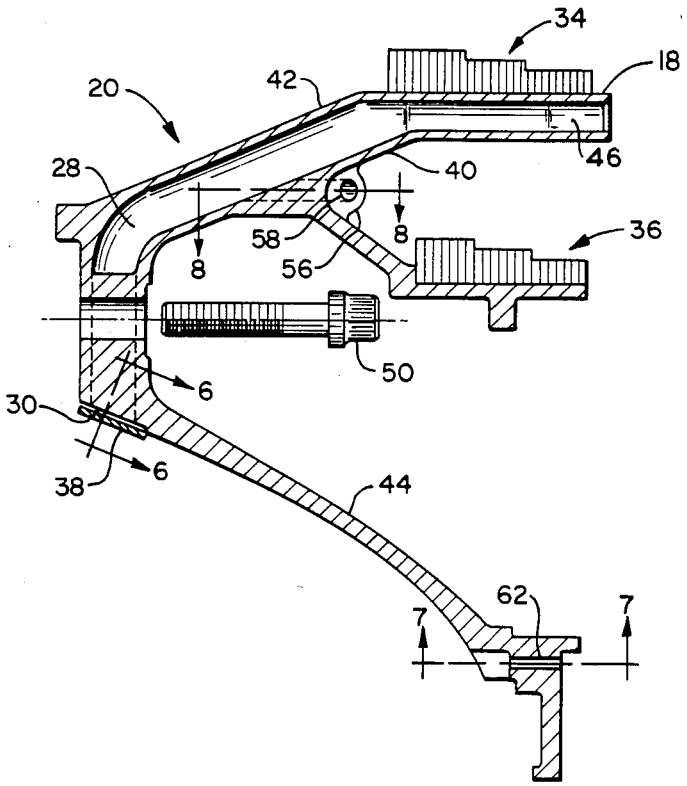
FIG. 2 shows a cross section of the manifold according to the present invention isolated from the surrounding engine structure.

FIG. 2 shows a cross sectional view of the manifold 20 according to the present invention removed from the engine so that other features may be more clearly discerned. A blocking plate 38 is shown in place covering a portion of the channel inlet opening 30 thereby restricting the flow of air into the channel 28. The manifold structure 20 is formed of a generally frusto-conical first wall 40 and a spaced apart frusto-conical second wall 42 which, in cooperation with a plurality of flow dividers 46 disposed therebetween, form the individual flow channels 28. The first and second walls extend radially inward and axially downstream from the openings 30 to the nozzles 18. A third frusto-conical wall 44 extends radially outward and downstream from proximate the openings 30 of the flow channels 28 and includes a peripheral mounting flange 66 for supporting the aft end of the combustor liner 24.

Figure 4:
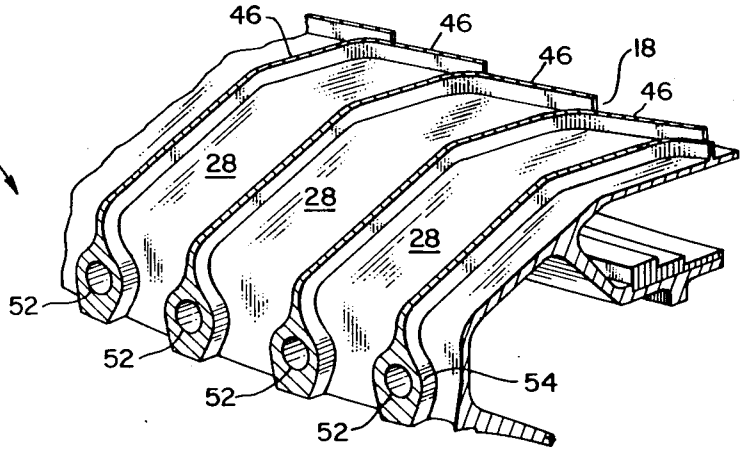
FIG. 4 shows the adjacent flow channels of the manifold with the upstream frusto-conical wall removed.
Figure 3:
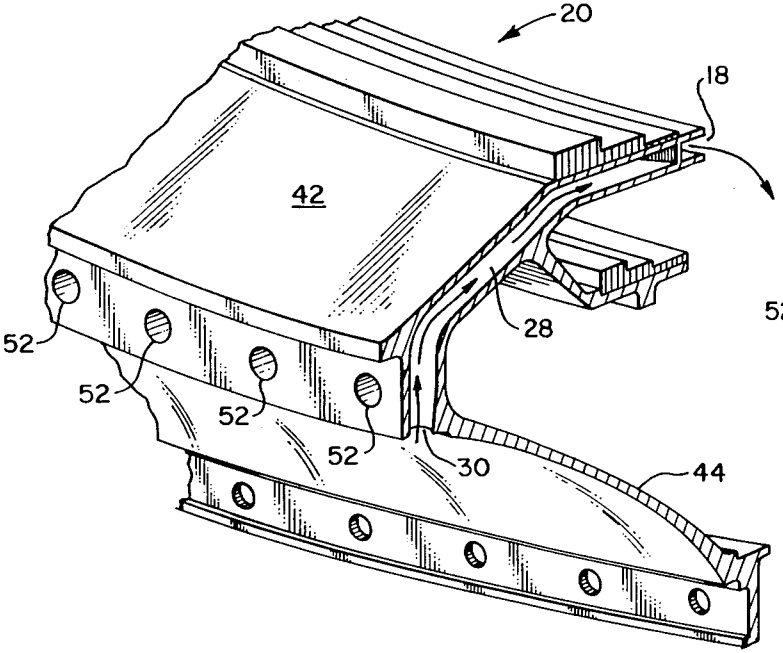
FIG. 3 shows a perspective view of a portion of the manifold according to the present invention.

FIGS. 3 and 4 provide the best illustration of the flow of air through the flow channels 28. Each flow channel 28 is separated from each adjacent flow channel by a divider 46. Unlike prior art manifold configurations, the manifold 20 according to the present invention does not intermingle or distribute cooling air received therein prior to discharge from the nozzle region 18. Rather, each flow channel 28 has its own inlet opening 30 and discharge nozzle 18, providing an uninterrupted and completely defined flow path for the cooling air passing therethrough. The radially inward portion of each flow divider 46 is skewed in the circumferential direction to form a plurality of tangentially directed nozzles 18 for imparting the desired velocity and swirl to the discharged cooling air 14.

The manifold 20 according to the present invention is secured to the engine frame 48 (see FIG. 1) by a plurality of axially extending mounting bolts 50 passing through corresponding mounting holes 52 disposed in a thickened boss region 54 of each flow divider 46. The use of a thickened boss region in each flow divider 46 allows the manifold 20 according to the present invention to be securely mounted to the engine frame or case 48 without disrupting or separating the flow of cooling air through the individual flow channels 28.

Unlike prior art designs wherein air flow received through a plurality of flow openings is intermingled in a plenum region within the manifold and subsequently discharged through a plurality of nozzle openings, the manifold 20 according to the present invention provides a carefully constructed and completely defined flow path for each portion of the cooling air stream flowing therethrough. The uniformity of the flow channels thus provides a uniformity of air delivery unachievable in prior art manifold designs.

The double wall and divider configuration of the manifold 20 allows the use of thinner and hence lighter walls as compared to the prior art plenum type arrangement, without reducing manifold structural strength. In addition, the thickened boss region 54 by serving a dual function in locally strengthening the manifold 20 and dividing flow between adjacent channels 28, avoids the extra, separate mounting structures and increased weight of prior art manifolds.

Figure 6:
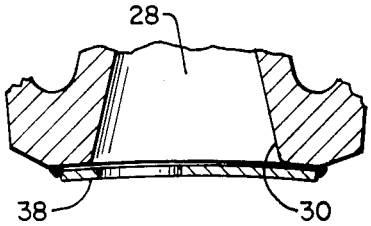
FIG. 6 shows a detailed view of the inlet opening of one flow channel showing the attachment of a blocking plate.

As discussed hereinabove, it may be necessary to alter the flow of cooling air through the manifold, either collectively or locally to accommodate the cooling needs of the turbine rotor at various developmental power levels over the life of the associated gas turbine engine model. This variation may be accomplished as most clearly seen in FIG. 6 by securing one or more blocking plates 38 over a portion of the channel opening 30 as shown. The blocking plates may be secured by welding or other means well known in the art and sized to admit the appropriate amount of air into the corresponding flow channel 28.

Figure 8:
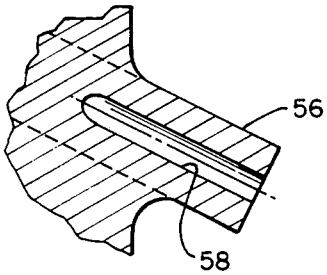
FIG. 8 shows a detailed cross section of the flow trim boss and hole disposed therein.

Minor flow adjustments as well as a slight increase in overall flow may be provided via the flow trim boss structure 56 shown in FIGS. 2 and 8. The flow trim boss 56 is a thickened portion of the first frusto-conical manifold wall 40 through which a flow trim hole 58 may be drilled as necessary to allow a portion of the cooling air within a flow channel 28 to bypass the corresponding nozzle 18 and enter the turbine disk cavity 60 adjacent the sideplate-manifold rotating seal 36. By proper sizing of the flow trim hole 58, the flow of bypass air therethrough may be controlled to match the air flow leakage expected through the sideplate seal 36, thereby maximizing the cooling effectiveness of the radially flowing cooling air 14 discharged from the manifold nozzle portion 18.

Figure 7:
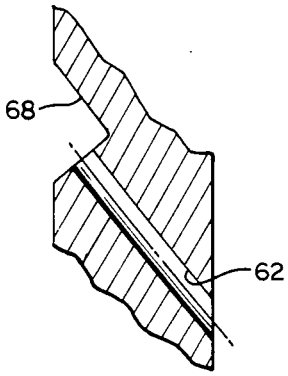
FIG. 7 shows a detailed view of a cooling hole disposed in the radially outer periphery of the manifold structure.

Additional cooling for the radially inward portion of the turbine blades 12 is provided by a plurality of skewed holes 62 provided in the radially outer periphery of the third frusto-conical wall 44. The skewed holes 62 shown in FIGS. 2 and 7, are oriented to tangentially discharge secondary cooling air adjacent the upstream surface of the turbine rotor 10 and blade 12 to prevent hot combustion gases from flowing radially inward past the turbine blade platform 64 (see FIG. 1). The skewed holes 62 are drilled in the peripheral flange 66 and have a tooling access groove 68 cast in the manifold for assisting the drilling process.

Figure 5:
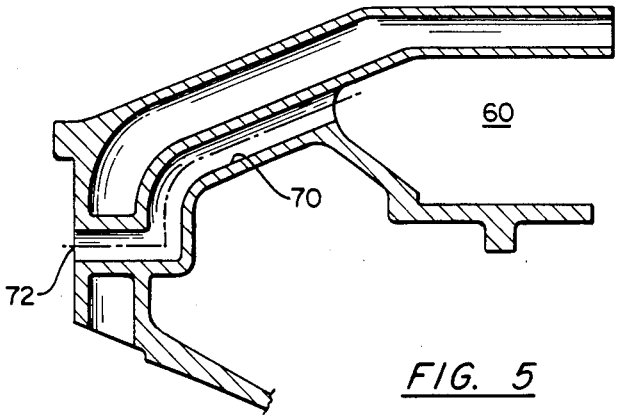
FIG. 5 shows a cross section of the manifold taken through the pressure tap passage.

The double wall construction of the manifold 20 according to the present invention, while providing a uniform flow of cooling air 14 adjacent the rotating turbine disk 10, does not permit a simple pressure tap opening for monitoring the pressure within the turbine disk volume 60 and hence the flow of cooling air 14 therein. The manifold 20 according to the present invention maintains this desirable monitoring function of the prior art by providing an internal pressure tap passage 70 for maintaining fluid communication between the turbine disk volume 60 and a pressure tap opening 72 located on the upstream manifold surface as shown in FIG. 5. The pressure tap passage 70 is formed within the manifold 20 and located circumferentially intermediate one pair of flow dividers 46. While shown as being disposed radially coincident with the mounting bolts 50, it will be appreciated that the pressure tap opening 72 may be in fact disposed in a variety of locations on the upstream manifold surface which may be equally convenient for connection to a pressure monitoring means (not shown) or the like.

The manifold structure 20 according to the present invention is thus an integrated, adjustable cooling air delivery structure which is well suited for supplying a uniform flow of cooling air over the upstream face 11 of a turbine rotor 10 in a gas turbine engine.

It will be appreciated that other embodiments and configurations of cooling manifolds may be made without departing from the scope of the present invention as illustratively set forth hereinabove. As a result, the foregoing description should not be interpreted as limiting the scope of the present invention which is set forth in the following claims.

I claim:

1. A cooling air delivery manifold for supplying an annular rotating flow of cooling air to one side of a rotating turbine disk, comprising:

a first generally frusto-conical wall extending radially outward and axially upstream from adjacent the rotating disk;

a second generally frusto-conical wall, spaced radially inward and axially upstream of the first wall;

a third wall, secured to the upstream end of the first wall and extending radially outward and axially upstream therefrom, the third wall including an annular mounting flange at the radially outer end for supportably engaging an annular combustor outlet nozzle;

a plurality of flow dividers extending between the first and second walls for forming a plurality of separate air flow channels therebetween, the radially inner end of each flow divider being skewed circumferentially with respect to the rotation axis of the disk for forming a plurality of skewed flow nozzles, and the axially upstream end of each flow divider including a thickened portion defining a boss, the boss including an axially extending hole therethrough for receiving a mounting bolt; and a plurality of skewed cooling air holes disposed proximate the mounting flange of the third wall, the holes being skewed with respect to the rotation axis for delivering a flow of cooling air adjacent the periphery of the rotating disk.

2. The manifold as recited in claim 1, further comprising:

a pressure tap passage disposed adjacent the first wall and passing axially upstream across one of the plurality of air flow channels for providing fluid communication between an air volume adjacent the rotating disk and a pressure tap opening on an upstream surface of the manifold.

3. A cooling air delivery manifold for supplying an annular rotating flow of cooling air to one side of a rotating turbine disk, comprising:

a first generally frusto-conical wall extending radially outward and axially upstream from adjacent the rotating disk;

a second generally frusto-conical wall, spaced radially inward and axially upstream of the first wall;

a plurality of flow dividers extending between the first and second walls for forming a plurality of separate air flow channels therebetween, the radially inner end of each flow divider being skewed circumferentially with respect to the rotation axis of the disk for forming a plurality of skewed flow nozzles, and the axially upstream end of each flow divider including a thickened portion defining a boss, the boss including an axially extending hole therethrough for receiving a mounting bolt; and an annular rotating seal disposed between the first wall and a sideplate secured to the rotating disk, the seal extending axially downstream from the first wall from a point intermediate the axially upstream and downstream edges thereof, the first wall further having a thickened trim boss disposed adjacent the sideplate seal and radially inward thereof, the trim boss including a trim flow passage opening at one end in the corresponding flow channel and at an other end in an annular volume formed between the rotating disk and the first wall, the passage further being sized to deliver air to the annular volume at a rate substantially equivalent to any leakage through the sideplate seal.

* * * * *